US009282803B2

(12) United States Patent
Ciervo

(10) Patent No.: US 9,282,803 B2
(45) Date of Patent: Mar. 15, 2016

(54) ULTRASONIC COSMETIC APPLICATOR

(71) Applicant: Donald John Ciervo, Merrick, NY (US)

(72) Inventor: Donald John Ciervo, Merrick, NY (US)

( * ) Notice: Subject to any disclaimer, the term of this patent is extended or adjusted under 35 U.S.C. 154(b) by 0 days.

(21) Appl. No.: 14/045,231

(22) Filed: Oct. 3, 2013

(65) Prior Publication Data

US 2015/0097050 A1 Apr. 9, 2015

(51) Int. Cl.
*B05B 17/06* (2006.01)
*A45D 34/04* (2006.01)

(52) U.S. Cl.
CPC ..... *A45D 34/04* (2013.01); *B05B 17/0607* (2013.01); *A45D 2200/057* (2013.01); *A45D 2200/207* (2013.01)

(58) Field of Classification Search
CPC ..... B05B 17/063; B05B 17/0623; B05B 17/0646; B05B 17/06
USPC ..... 239/102.1, 102.2, 302, 375, 376, 345; 604/22, 68; 601/2, 15, 17; 128/200.16
See application file for complete search history.

(56) References Cited

U.S. PATENT DOCUMENTS 4,877,989 A * 10/1989 Drews ..... B05B 17/0623 128/200.16
6,569,099 B1 * 5/2003 Babaev ..... A61M 3/0275 600/437
6,663,554 B2 * 12/2003 Babaev ..... A61M 11/005 600/2
6,964,647 B1 * 11/2005 Babaev ..... A61M 11/005 601/2
8,061,629 B2 * 11/2011 Tranchant et al. ..... 239/102.2
8,096,489 B2 * 1/2012 Fedorov ..... 239/345
8,720,435 B2 * 5/2014 Gallem ..... A61M 11/005 128/200.14
2009/0043248 A1 * 2/2009 Peterson ..... A61B 17/20 604/22

* cited by examiner

*Primary Examiner* — Len Tran
*Assistant Examiner* — Tuongminh Pham

(57) ABSTRACT

A portable ultrasonic cosmetic applicator for spraying makeup/sterilants onto the body or face. Eliminates the use of noisy compressors, pressurized cylinders and air lines. Characterized by a small, lightweight device without the use of cumbersome attachments or pumps. Produces a fine misty spray that is easily applied with a smaller and more uniform droplet size than commonly used spray equipment or hand applicators, thus reducing the amount of unused cosmetics.

3 Claims, 5 Drawing Sheets

ULTRASONIC COSMETIC APPLICATOR

BACKGROUND OF THE INVENTION

Cosmetics have been around for over 3000 years. The Egyptians were the first to use pigments, crushed berries and leaves, and the upper class would purchase makeup from incoming travelers. This not only cost a great deal of money for that time period, but took up to a month or longer to make. At first, men would use makeup by applying galena or kohl (black eye-liner) to create an "almond shaped eye" which resembles the Falcon Eye of the God Horus. Women then began to experiment the use of cosmetics. The application of such substances was with a small stick or wooden needle with an enlarged end creating a cotton bud shape. Along with black eye-liner, the men of ancient Egypt applied green eye shadow/paints, in addition to lip balm or salve colored with natural earth pigments, such as red ochre.

It was said that the natives believed makeup could ward off evil spirits and protect against eye diseases and ocular infections caused by the Nile River. Kohl promoted the production of nitric oxide in the skin which strengthened their immune systems. In addition, the soot found in kohl helped to reduce the damaging effects of sun glare on the eyes. After the ancient Egyptians discovered the use of cosmetics, the word began to spread and new ideas began to form.

Airbrush, in general, was first established by a man named Abner Peeler in 1879 using mostly spare parts from a jewelers workshop. Four years later, a company by the name of Liberty Walkup began marketing his invention. In 1893, Thayer and Chandler art materials presented the first known modern airbrush at the world Columbian Exposition in Chicago. At the time, the airbrush invention had the sleek look of a pen and its functionality was extremely similar to recent airbrush machines in today's society. 1958 began the production of the film Ben-Hur which was completed in 1959 by MGM Studios. Cosmetics were applied using airbrush during the set of this world-renowned film. Makeup artists were told to apply faux tans for the thousands of actors who played minor roles and were said to be acting the part of Romans. The idea of using airbrush with this substance, as a makeshift foundation, worked surprisingly well. It was found that an airbrush can spray cosmetics more precisely, lighter, and efficiently. Airbrush soon became well known for applying cosmetics for Hollywood studios in the mid 1970s. Then it made its way into hair and beauty trade shows and the Bal Masque competitions. Nowadays, airbrush is commonly used for creating temporary tattoos, conventional makeup, fantasy makeup, body art, fingernails, hair, and airbrush tanning.

Sonaer has been making ultrasonic atomizers nozzles since 1997. An ultrasonic atomizer nozzle works by the same principle of wave motion as does all other ultrasonic devices such as liquid processors, welders, surgical tools, dental instruments and the like. It is no secret that an atomizer nozzle is any one of the above-mentioned devices, however, it is made with a hole through the center or a plurality of holes for spraying a liquid. One of the nicest aspects of using an atomizer nozzle is the fact that finer particles are easily produced, and spray is more uniform and efficient when expelled from the tip end without the use of air pressure. Knowing the advantages of an atomizer nozzle, I have invented a cosmetic applicator that contains within an ultrasonic atomizer nozzle with the exception that it does not include the center hole. In addition to the atomizer nozzle, I have invented an applicator hand piece that includes a method of either pouring cosmetics into a well molded into the device or threading a small vial of cosmetic solution to the top of the applicator. Contained along the side of the applicator is a method of turning on the ultrasonic power, thus directing cosmetic solution to the vibrating tip for spraying. This is all accomplished without a hole through the center or along the side of the probe for the liquid and is delivered to the moving tip without the use of air pressure or a pump. The invention I am presenting is truly a unique and novel method for spraying cosmetics.

OBJECT AND SUMMARY OF THE INVENTION

The object of the invention is to use the latest formulation of cosmetics to efficiently spray and direct small uniform particles onto the skin's surface. It is also an object of the disclosed invention to do the above-mentioned task without the use of an air hose, pressure cylinder, pump or compressor as is commonly used with airbrushing or atomization. Airbrushing is considered state-of-the-art in applying today's cosmetics. Normally with an airbrush paint or cosmetic are held in a glass container attached to the hand piece shaped like a pen and is easy to hold. A compressor located in an area away form the user supplies pressurized air to the airbrush through a tube attached to the rear of the airbrush hand piece. A button is pressed activating a valve to direct air to the tip of the hand piece. This is used to pick up the paint or cosmetic to be sprayed. The liquid air mixture leaves the airbrush with a velocity and angle based on the pressure and tip configuration. The user has to constantly maneuver the airbrush to keep the tube from getting in the way of the subject being covered.

Atomizer nozzles that Sonaer makes have piezoceramics sandwiched between two end masses. The ceramics convert an alternating voltage applied to the ceramics to mechanical motion. This motion is amplified by the shape of the end mass tip. Usually, a smaller diameter end mass amplifies the motion of the ceramics and a larger diameter end mass reduces the motion. Through the center of the atomizer nozzle is an orifice with a means of connecting a liquid line at the back of the nozzle. As liquid is pumped through the center of the probe, mechanical vibrations like that of a piston, pulverize the liquid into a fine particle. Particles that reach the tip are formed into a spray. The sprays for this type of atomization are known to be finer than in air pressurized, water pressurized, and all other methods of mechanical spray. The fine spray is made possible due to the frequency of the nozzle. Typically a nozzle with a higher frequency, makes a smaller particle size than that of a lower frequency. Any atomizer nozzle in the frequency range of 20,000 Hz and higher will make a smaller particles than a mechanical device that spins or vibrates at a frequency lower then 20,000 Hz, including air and liquid assisted atomization.

With the invention I am presenting, the user does not have to worry about the air supply tube, which will get in the way from time to time, or the adjustment of air pressure to the airbrush. Atomizer nozzles which function with liquid being pumped through the center are also not needed. Using skills learned in the trade of airbrushing cosmetics, this invention alleviates obstacles of conventional airbrushing and atomization and gives the applicant a soft delicate spray of material that is uniform and soothing using the principals and properties of ultrasonics. A further understanding of the invention will be better realized by the detailed description of the embodiments below.

DETAILED DESCRIPTION OF THE EMBODIMENTS

Figure 1:
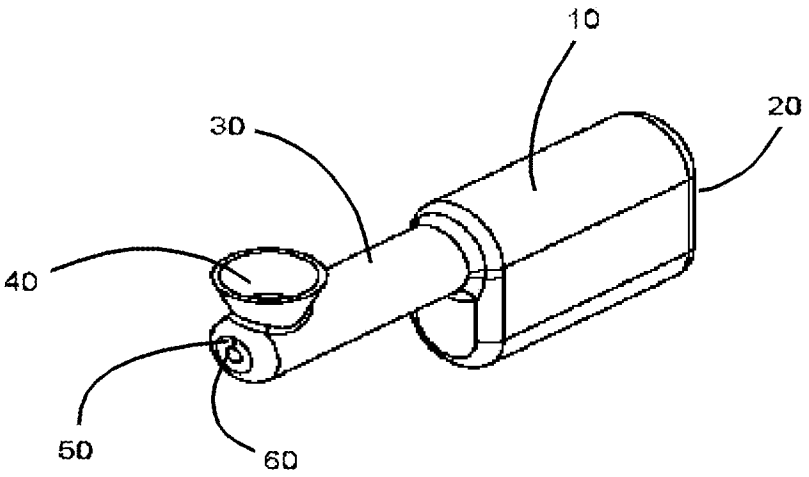
FIG. 1 is an overall view of the disclosed cosmetic applicator according to the invention and external embodiments for spraying cosmetics onto the face and body.

Referring now to the drawings wherein like reference characters designate like or corresponding parts throughout, there is illustrated in FIG. 1, an ultrasonic cosmetic applicator 10 for spraying atomized particles made from cosmetic materials onto the body or face. The cosmetic applicator 10 has a back cover 20 which covers the internal components and helps with assembly. Components are loaded from the rear of the cosmetic applicator 10 up to the distal end 60 where they are secured inside the unit. Along the length of the cosmetic applicator 10 is the frontal control mechanism 30. The frontal control mechanism 30 contains many features that make the cosmetic applicator 10 function according to the invention disclosed which will be discussed within this disclosure. At the distal end 60 is a liquid delivery well 40 that is used in pouring the cosmetic materials into. At the bottom of the liquid delivery well 40 and moving to the distal end 60 is a liquid delivery orifice 50. The liquid delivery orifice 50 directs the cosmetic to the distal end 60 from the liquid delivery well 40 where the liquid is made into a particle for spraying. Once the liquid delivery well 40 is filled with a few drops of cosmetic liquid the unit is ready to spray cosmetics to the body and face.

Figure 2:
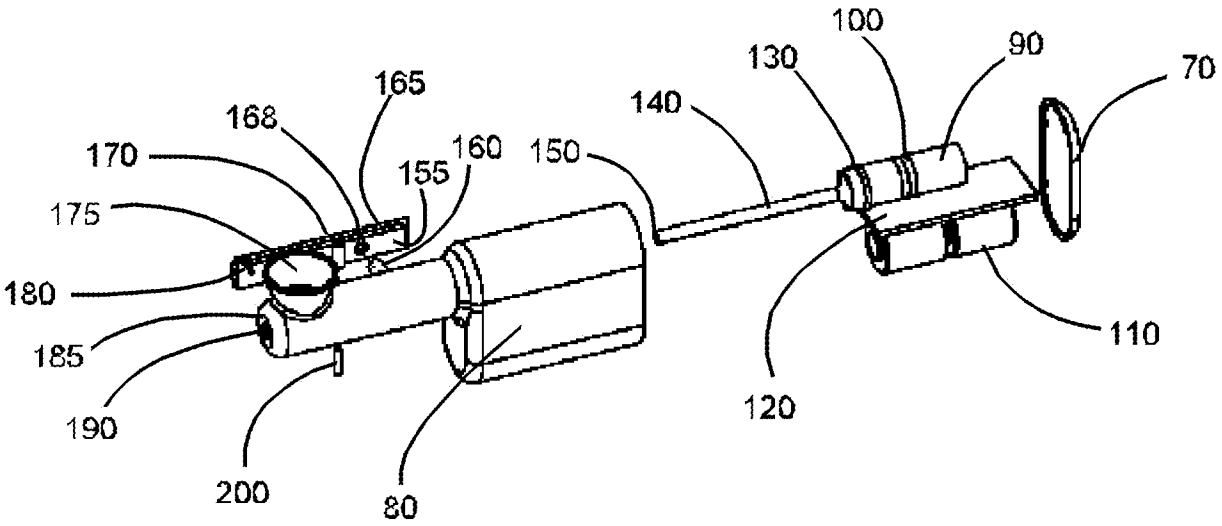
FIG. 2 is a view of components required for the invention to spray cosmetics using an ultrasonic atomizer and unique valve switch combination.

In reference to FIG. 2 of the disclosed invention presented is a detailed view of the components necessary for this device to operate as a handheld unit without air pressure that is commonly used with an air brush. The main body of the cosmetic applicator 80 contains within several main components that enable this device to work according to the invention presented. The primary atomizer device 130, cosmetic applicator 80, and the valve switch plate 170, make up the bulk of components needed for this invention to work as described in the application. The primary atomizer device 130 is a typical sandwich transducer that is well known since the 1960's. It is made up of these basic components: Center piezoelectric ceramics 100, and two end masses. These end masses are labeled the rear driver 90 and the front driver 140. Together they make up a resonant body which vibrates at ultrasonic frequencies. Typically these frequencies are between 20,000 cycles per second up as high a 500,000 cycles per second. These three component parts make up the ultrasonic atomizer device 130 and is well known in the industry. This application will not focus on the atomizer device 130 and will be discussed briefly since this application is not teaching anything that is not already known in the field of ultrasonics. To power the ultrasonic atomizer device 130 is a driver circuit board 120 with integrated circuit chips that make up an oscillator, power amplifier and control circuit all of which are also well known in the industry and will not be discussed in depth within this application. Energy to operate the system is derived with batteries 110 and all the component parts listed above is enclosed into the cosmetic applicator 80 by use of the rear cover 70. What will be discussed is the novel method of creating sprays comprised of particles for use with cosmetics, or for that matter many other liquids, with the disclosed invention. To direct our energy to the true essence of this invention, lets take a look at the valve switch plate 170, the cosmetic applicator 80 and the distal tip end 150 of the atomizer and see how these pieces work together.

In order to examine the valve switch plate 170 and how this piece functions in conjunction with liquid delivery and ultrasonic atomization, one can see that the valve switch plate 170 has a pin 180 attached and is actually part of the valve. During assembly the valve switch plate 170 is secured to the cosmetic applicator 80 by use of a roll pin 200. This method allows the valve switch plate 170 to pivot like a seesaw at the point where the roll pin 200 connects to the cosmetic applicator 80. A spring 160 is placed between the valve switch plate 170 and the cosmetic applicator 80, which is sitting in a counter bore 168 keeping the spring 160 secured in position while operating the cosmetic applicator 80. Applying a force to the side 165 of the valve switch plate 170 opposite the spring 160 force, will move the pin 180 away from the front portion 190 of the cosmetic applicator 80. With this force applied by the spring 160 the valve switch plate 170, pin 180 rides inside the front portion 190 of the cosmetic applicator 80 and is kept in place with the roll pin 200. As one side of the valve switch plate 170 goes up the other down and vice-versa. During this period, the pin 180 of the valve switch plate 170 will open and close an orifice 185 that bridges from the front portion 190 and the liquid delivery well 175. With the valve switch plate 170 open, liquids will flow through the orifice 185 from the liquid delivery well 175 and onto the distal tip 150 of the atomizer device 130. At the same time a contact 155 engages connections in the cosmetic applicator 80, enabling power to the driver circuit board 120, which in turn powers up the atomizer device 130 creating ultrasonic vibration and atomizing the liquid deposited on the distal tip 150.

Figure 3A:
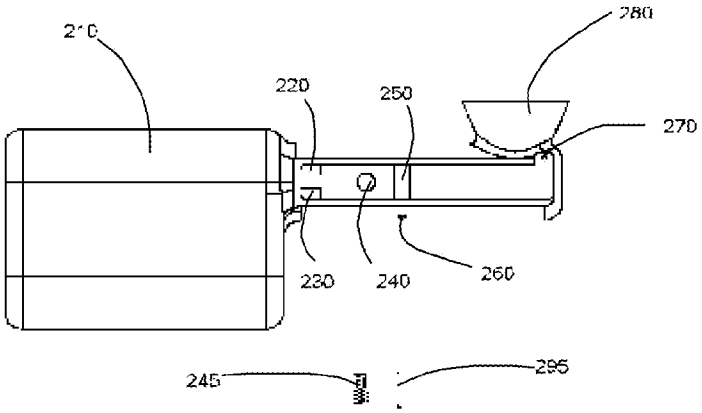
FIG. 3*a* is a side profile of the invention illustrating the valve switch combination used to activate the atomizer nozzle and open a valve for allowing cosmetics to be deposited onto the atomizer tip.
Figure 3B:
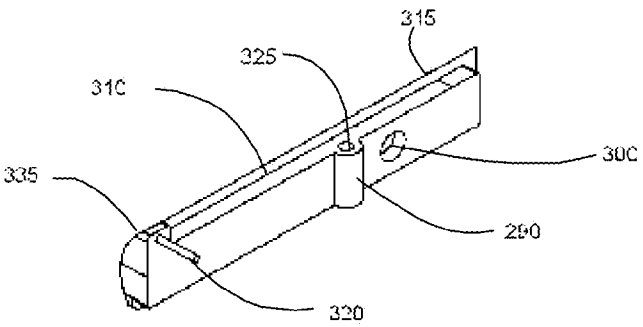
FIG. 3*b* shows the valve switch control arm that the user presses for spraying cosmetics.

In reference to FIG. 3*a* of the disclosed invention is a side profile of the atomizer device 210, beneath that a spring 245, roll pin 295, and valve switch plate 310 FIG. 3*b*. These four components make up the valve and switch connection that activates ultrasonic power creating atomization from liquids and cosmetics. Reviewing the atomizer device 210, there are two electrical connections 220 and 230. Each one has a wire connection to the printed circuit board inside the unit. On the right of the electrical connections 220 and 230 of the atomizer device 210 is a counter bore 240, followed by a pivoting slot 250, and roll pin hole 260. To the right of the counter bore 240 and roll pin hole 260 is the liquid delivery well 280 and the valve relief hole 270. The valve switch plate 310 has matching forms made within that fit the atomizer device 210 allowing it to function as a valve and switch combination. Fitment of these four components and how they function will be better understood by viewing FIGS. 3*a* and 3*b*. With the two pieces FIG. 3*a* and FIG. 3*b* configured together comprising the atomizer device 210 and the valve switch plate 310, the valve pin 320 fits into the valve relief hole 270, the counter bore 240 of the atomizer device 210 aligns evenly with the counter bore 300 of the valve switch plate 310 and pivoting boss 290 of the valve switch plate 310, fits into the pivoting slot 250 of the atomizer device 210. The spring 245 fits into the counter bore 240 of the atomizer device 210 and also the counter bore 300 of the valve switch plate 310. Each piece is secured together with the roll pin 295 being pressed into the roll pin hole 260 of the atomizer device 210 and through the hole 325 of the valve switch plate 310. With the assembly fitted together the valve switch plate 310 can now move in a out as a lever with a fulcrum. The lever is the valve switch plate 310 and the fulcrum is the pivoting boss 290 shown on the valve switch plate. As one side 315 of the valve switch plate 310 moves in, the opposite end 335 moves out. When the one side 315 of the valve switch plate 310 moves in, the spring 245 compresses and contact is made between electrical connections 220 and 230 activating the system. At the same time the valve pin 320 is pulled out from the valve relief hole 270 causing the cosmetic or liquid to flow and is made into a mist or spray. Releasing the side 315 of the valve switch plate will push the side 315 away from the electrical contact 220 and 230 and at the same time push in the valve pin back into the valve relief hole 270 closing the flow of cosmetic or liquid and shutting of the spray.

Figure 4A:
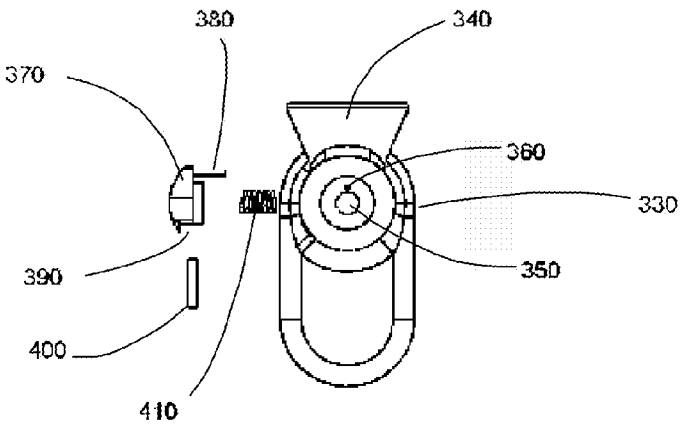
FIG. 4*a* is a front view of the disclosed invention showing the tip portion of the cosmetic applicator and novel mechanism for spraying and activating the device.
Figure 4B:
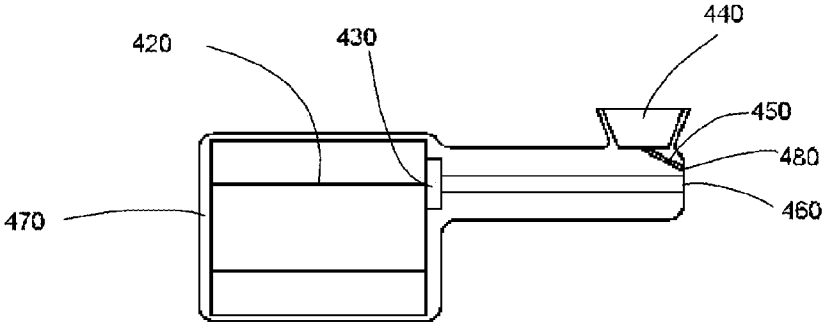
FIG. 4*b* is a cut through the center view of the cosmetic applicator exemplifying the internal orifices required for depositing cosmetics onto the atomizer tip.

In reference the FIG. 4*a* of the disclosed invention is a front view of the cosmetic applicator 330 and FIG. 4*b* a cutaway side view 435. The front view contains the spring 410, the roll pin 400, and the valve switch plate 370. The cosmetic applicator 330 has a liquid delivery well 340, a distal tip portion 350 where liquid is sprayed, and a liquid orifice 360. The cosmetic applicator 330 has contained within the liquid delivery well 340, distal tip portion 350 where cosmetic or liquid is sprayed and the liquid orifice 360. The side view of the valve switch plate 370 shows the valve pin 380 and the pivoting boss 390. The side view in FIG. 4*b* exemplifies the distal tip portion 460, liquid orifice 480, valve relief hole 450, liquid delivery well 440, transducer channel 430, electronics compartment 420, and back cover 470.

Referring to the cosmetic applicator 330, a few drops of cosmetic is poured into the liquid delivery well 340. Manipulating the valve switch plate 370 will compress the spring 410 as it moves about the fulcrum pivoting boss 390 which has pin 400 through it. This lever action pulls the valve pin 380 away from the liquid orifice 360 allowing cosmetic to flow through the liquid orifice 360 and deposit onto the distal tip portion 350. At the same time, electrical power is delivered to the device and a mist or spray from the cosmetic will be made. In FIG. 4*b* the liquid delivery well 440 has an angled hole labeled liquid orifice 480 which has an additional hole through namely valve relief hole 450. The two holes liquid orifice 480, and valve relief hole 450, make up the valve system and liquid path for the cosmetic to be sprayed. As liquid travels through the liquid orifice 480 it is deposited on the distal tip portion 460. The cosmetic applicator also has provisions for the internal electronic components and ultrasonic probe shown in FIG. 2. Keeping all the components inside the applicator is the back cover 470. This is removable for servicing and ease of assembly.

Figure 5:
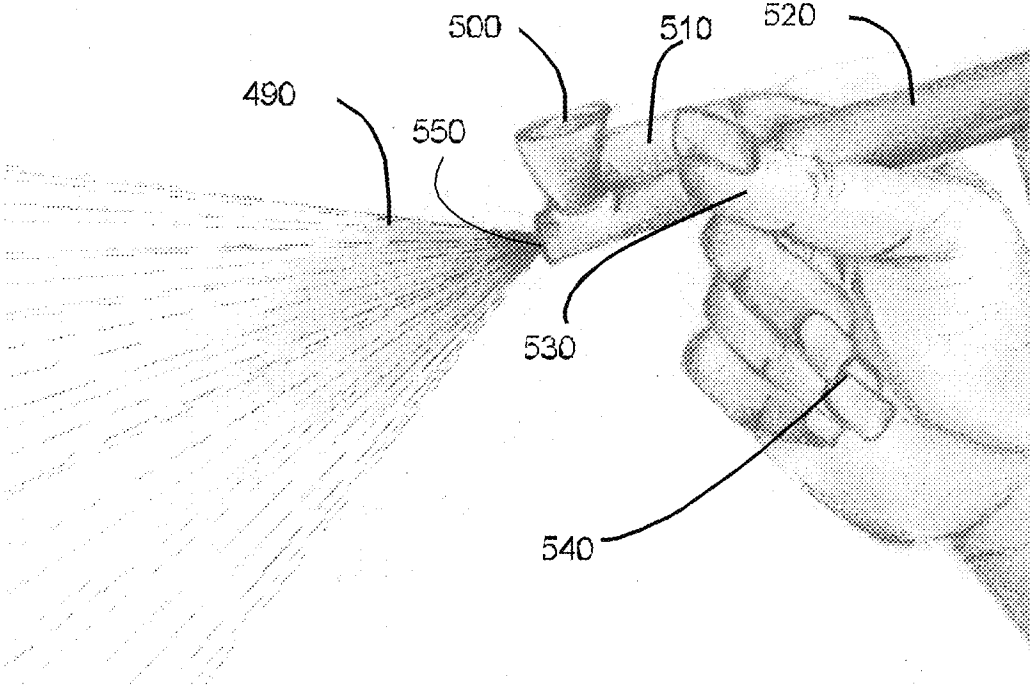
FIG. 5 is a artist's drawing of the cosmetic applicator being used for spraying liquid material.

FIG. 5 of the cosmetic applicator 520 shows the unit held in ones hand 540 between the thumb 530 and the index finger 510. After filling the liquid delivery well 500 with cosmetic, the index finger 510 is used to press the valve switch plate 170 to activate the ultrasonic atomizer device 130, both shown in FIG. 2. At the same time, the cosmetic within the liquid delivery well 500 will flow to the distal tip portion 550 where it is atomized into fine particles 490. The fine particles 490 are smaller than air brush sprayers and less material is used to place on the face and body.

In conclusion, I am demonstrating the ability to atomize cosmetics using an ultrasonic atomizer that is commonly known and manufactured by Sonaer, Inc. Many other configurations may be made to the cosmetic applicator such as attaching small bottles or tubes to replace the liquid delivery well, or by adding additional features such as hand grips, for example. I have disclosed the ability to spray liquids, mainly cosmetics, without the use of air pressure, and by using a unique mechanism designed to enable ultrasonic energy to release cosmetics for spraying into fine particles. These fine particles use less material, thus precipitating a cost savings to the user.

What is claimed is:

1. A cosmetic applicator comprising:

an ultrasonic device to atomize a cosmetic liquid held in a delivery well via a vibrating distal tip, the device comprising:

a longitudinal main body having a proximal end and a distal end;

a rear cover located at the proximal end;

a frontal control mechanism, wherein the delivery well is located on the frontal control mechanism at the distal end of the main body;

a liquid delivery orifice at a distal end of the control mechanism, the delivery well having a valve relief hole at a bottom of the well configured to meter the cosmetic liquid onto the vibrating distal tip, wherein the vibrating distal tip being located at the distal end of the frontal control mechanism;

a valve switch plate assembly comprising:

a longitudinal valve switch plate having a proximal end and a distal end;

a valve pin attaching to the valve relief hole;

a roll pin configured to pivot the valve switch plate on a vertical axis defining a fulcrum;

a spring biasing the valve switch plate against the main body of the ultrasonic device, a piezoelectric ceramic at the proximal end of the main body; and wherein the piezoelectric ceramic is connected to a circuit board and batteries located at the proximal end of the main body.

2. The cosmetic applicator of claim 1, wherein the distal end of the valve switch plate has a pressed state and an unpressed state, wherein in the pressed state, the device is configured to generate ultrasonic vibration at the vibrating distal tip, and the valve switch plate unplugs the valve relief hole such that the cosmetic liquid is delivered on to the vibrating distal tip.

3. The cosmetic applicator of claim 1, wherein the cosmetic liquid is configured to be discharged via the liquid delivery orifice in small particles by the ultrasonic vibration of the vibrating distal tip.

* * * * *